United States Patent [19]

Zumbusch

[11] Patent Number: 4,480,972

[45] Date of Patent: Nov. 6, 1984

[54] GEROTOR MOTOR AND CASE DRAIN FLOW ARRANGEMENT THEREFOR

[75] Inventor: Steven J. Zumbusch, Eden Prairie, Minn.

[73] Assignee: Eaton Corporation, Cleveland, Ohio

[21] Appl. No.: 499,664

[22] Filed: May 31, 1983

[51] Int. Cl.[3] ..... F01C 1/02; F03C 3/00

[52] U.S. Cl. ..... 418/61 B

[58] Field of Search ..... 418/61 B; 137/512

[56] References Cited

U.S. PATENT DOCUMENTS

| | | | |
|---|---|---|---|
| 3,797,519 | 3/1974 | Allen | 137/512 |
| 3,862,814 | 1/1975 | Swedberg | 418/102 |
| 3,887,109 | 6/1975 | Easton | 418/61 B |
| 3,973,880 | 8/1976 | Swedberg | 418/61 B |
| 4,035,113 | 7/1977 | McDermott | 418/61 B |

FOREIGN PATENT DOCUMENTS

| | | | |
|---|---|---|---|
| 46293 | 2/1982 | European Pat. Off. | 418/61 B |

*Primary Examiner*—William R. Cline

*Assistant Examiner*—John J. McGlew, Jr.

*Attorney, Agent, or Firm*—C. H. Grace; L. J. Kasper

[57] ABSTRACT

A rotary fluid pressure device is disclosed of the type including a gerotor displacement mechanism (17), a rotary valve member (55), and a valve seating mechanism (75). The valve seating mechanism includes a balancing ring member (77) seated in an annular groove (81) defined by the valve housing (21). Leakage fluid from the gerotor displacement mechanism passes from the central case drain region (83) through the bearings (33 and 35) to an annular chamber (87). The leakage fluid is communicated from the annular chamber (87) to whichever of the ports (75 or 61) is connected to the system reservoir, through a series of fluid passages (131, 133, 135, 137, and 139). The fluid passage (139) communicates with the annular groove (81), and the leakage fluid flows past whichever of the balancing ring seals (143 or 145) is subjected to low pressure fluid, the balancing ring seal thus acting as a check valve. The invention eliminates the complicated and expensive prior art check valve assemblies (103, 105).

10 Claims, 5 Drawing Figures

GEROTOR MOTOR AND CASE DRAIN FLOW ARRANGEMENT THEREFOR

BACKGROUND OF THE DISCLOSURE

The present invention relates to rotary fluid pressure devices such as low speed, high torque gerotor motors, and more particularly, to an improved case drain flow path arrangement for such a motor.

A typical motor of the type to which the present invention relates includes a housing defining an inlet port and an outlet port, and some sort of fluid energy-translating displacement mechanism such as a gerotor gear set. The motor further includes stationary valve means communicating with the volume chambers of the displacement mechanism, and a rotary valve member which provides communication between the ports and the stationary valve member.

Some motors of this type have a rotary valve which is referred to as a "fixed clearance valve", because the valve member is disposed between the stationary valve member and a fixed surface defined by the housing. Other motors of the type to which the invention relates are not fixed clearance, but instead, include some form of valve seating mechanism which biases the rotary valve member into engagement with the stationary valve member, and at the same time, separates the pressurized fluid from the return fluid.

Although the present invention may be used in a motor having either type of valving described above, it is especially advantageous when used in a motor having a valve seating mechanism, and will be described in connection therewith.

During normal operation of a gerotor motor, there is a certain amount of leakage of pressurized fluid from the gerotor gear set to a central case drain region of the motor. It is desirable to communicate this leakage fluid to the low pressure port to prevent the buildup of excessive fluid pressure on the shaft seals. This leakage fluid is typically used to lubricate certain elements of the motor which are subjected to substantial wear, such as the drive shaft connections and the bearings.

In the prior art motors of this type, such as shown in U.S. Pat. No. 3,572,983, communication of leakage fluid from the case drain region to whichever of the ports was connected to system reservoir was typically accomplished by means of a pair of check valve assemblies. In this arrangement, pressurized fluid would keep one of the check valves closed, while the other check valve would be subject only to return pressure, and slightly pressurized leakage fluid would unseat the check valve at low pressure and flow to the motor outlet. As is well known to those skilled in the art, such a check valve arrangement is necessitated by the fact that motors of this type are almost always required to be bidirectional, i.e., either port can be pressurized, depending upon the desired direction of rotation of the output shaft. The prior art check valve arrangement will be described in greater detail subsequently in the specification of the present application.

SUMMARY OF THE INVENTION

Accordingly, it is an object of the present invention to provide, in a motor of the type described above, an improved case drain flow path which substantially eliminates the complication and expense of the prior art check valve arrangement, and the associated machining and assembly.

It is another object of the present invention to provide an improved case drain flow path which makes use of certain motor elements which are already present in the motor to perform another function, unrelated to the case drain flow path.

The above and other objects of the present invention are accomplished by the provision of an improved rotary fluid pressure device of the type including housing means defining fluid inlet means and fluid outlet means, and a fluid energy-translating displacement means associated with the housing means, the displacement means defining expanding and contracting fluid volume chambers. A stationary valve means defines fluid passage means in fluid communiction with the expanding and contracting fluid volume chambers, and a rotary valve member defines valve passage means which provide fluid communication between the inlet and outlet means and the fluid passage means. The rotary valve member has a valve surface associated with the stationary valve means. The housing means defines annular chamber means neighboring the rotary valve member. First and second seal means are operably associated with the annular chamber means and cooperate with the housing means and the rotary valve member to define a first fluid chamber and a second fluid chamber. The first seal means substantially prevents fluid communication from the first fluid chamber to said annular chamber means, and said second seal means substantially prevents fluid communication from said second fluid chamber to said annular chamber means. Said fluid inlet means is in communication with one of the first and second fluid chambers, and the fluid outlet means is in fluid communication with the other of the first and second fluid chambers. The device includes a fluid drain region adapted to receive leakage fluid from the displacement means.

The improved device is characterized by the housing means defining fluid drain passage means providing relatively unrestricted communication between said fluid drain region and said annular chamber means. In addition, said first and second seal means are operable to permit communication of leakage fluid from said annular chamber means to said first and second fluid chambers, respectively, when said first and second fluid chambers, respectively, contain fluid at a pressure below the pressure of said fluid drain region.

DESCRIPTION OF THE PREFERRED EMBODIMENT

Figure 1:
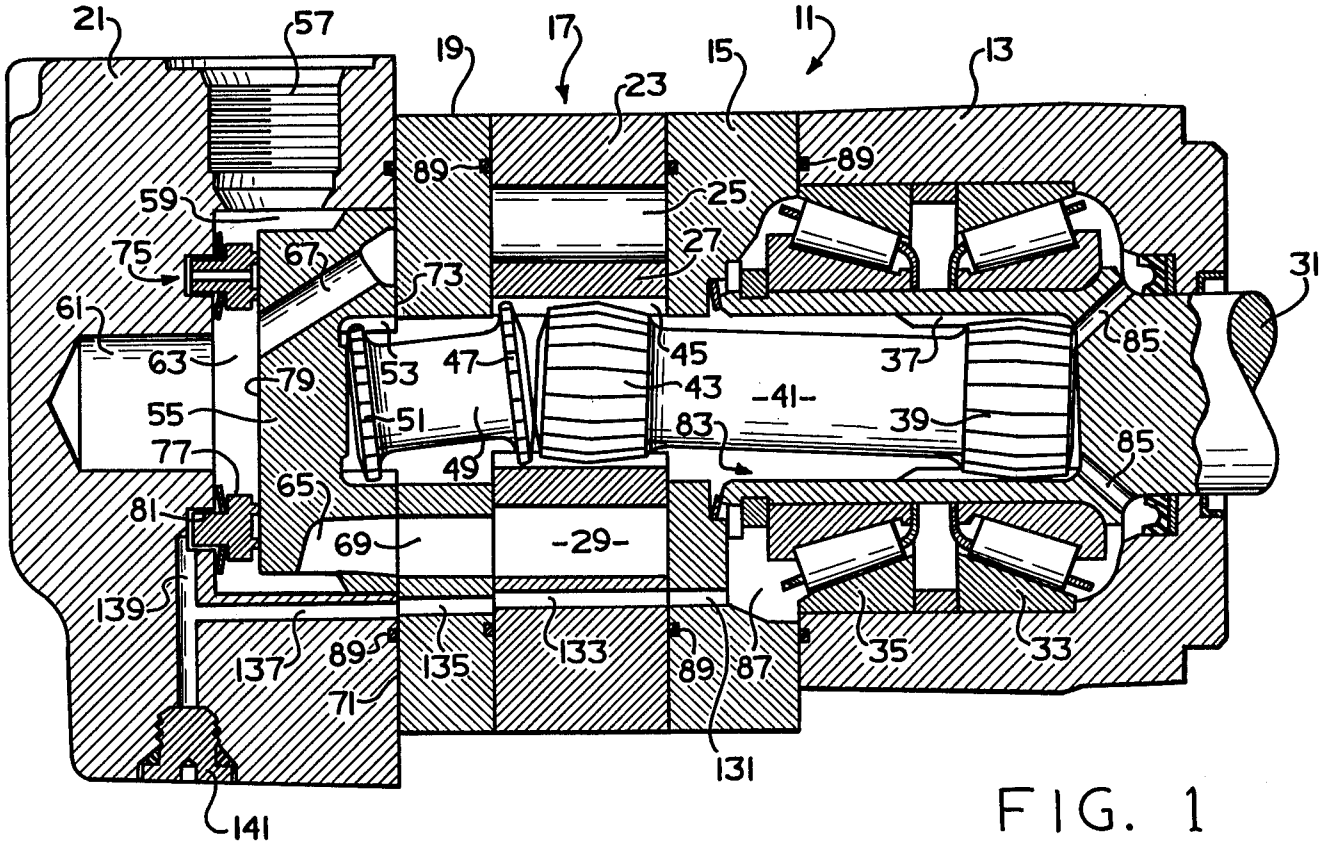
FIG. 1 is an axial cross section showing a low speed, high torque gerotor motor of the type to which the present invention may be applied.

Referring now to the drawings, which are not intended to limit the invention, FIG. 1 illustrates a low speed, high torque gerotor motor of the type to which the present invention may be applied, and which is illustrated and described in greater detail in U.S. Pat. Nos. 3,572,983 and 4,343,600, both of which are assigned to the assignee of the present invention and are incorporated herein by reference.

The hydraulic motor shown in FIG. 1 comprises a plurality of sections secured together, such as by a plurality of bolts (not shown). The motor, generally designated 11, includes a shaft support casing 13, a wear plate 15, a gerotor displacement mechanism 17, a port plate 19, and a valve housing portion 21.

The gerotor displacement mechanism 17 is well known in the art, is shown and described in great detail in the incorporated patents, and will be described only briefly herein. More specifically, the displacement mechanism 17 is a Geroler ® mechanism comprising an internally-toothed ring 23 defining a plurality of generally semi-cylindrical openings, with a cylindrical member 25 disposed in each of the openings. Eccentrically disposed within the ring 23 is an externally-toothed star 27, typically having one less external tooth than the number of cylindrical members 25, thus permitting the star 27 to orbit and rotate relative to the ring 23. The relative orbital and rotational movement between the ring 23 and star 27 defines a plurality of expanding and contracting volume chambers 29.

Referring still to FIG. 1, the motor includes an output shaft 31 positioned within the shaft support casing 13 and rotatably supported therein by suitable bearing sets 33 and 35. The shaft 31 includes a set of internal, straight splines 37, and in engagement therewith is a set of external, crowned splines 39 formed on one end of a main drive shaft 41. Disposed at the opposite end of the main drive shaft 41 is another set of external, crowned splines 43, in engagement with a set of internal, straight splines 45, formed on the inside diameter of the star 27. Therefore, in the subject embodiment, because the ring 23 includes seven internal teeth 25, and the star 27 includes six external teeth, six orbits of the star 27 result in one complete rotation thereof, and one complete rotation of the main drive shaft 41 and the output shaft 31.

Also in engagement with the internal splines 45 is a set of external splines 47 formed about one end of a valve drive shaft 49 which has, at its opposite end, another set of external splines 51 in engagement with a set of internal splines 53 formed about the inner periphery of a valve member 55. The valve member 55 is rotatably disposed within the valve housing 21. The valve drive shaft 49 is splined to both the star 27 and the valve member 55 in order to maintain proper valve timing therebetween, as is generally well known in the art.

The valve housing 21 includes a fluid port 57 in communication with an annular chamber 59 which surrounds the valve member 55. The valve housing 21 also includes an outlet port 61 which is in fluid communication with a chamber 63 disposed between the valve housing 21 and valve member 55. The valve member 55 defines a plurality of alternating valve passages 65 and 67, the passages 65 being in continuous fluid communication with the annular chamber 59, and the passages 67 being in continuous fluid communication with the chamber 63. In the subject embodiment, there are six of the passages 65, and six of the passages 67, corresponding to the six external teeth of the star 27. The port plate 19 defines a plurality of fluid passages 69 (only one of which is shown in FIG. 1), each of which is disposed to be in continuous fluid communication with the adjacent volume chamber 29.

The port plate 19 also defines a transverse valve surface 71, and the valve member 55 defines a transverse valve surface 73 in sliding, sealing engagement with the surface 71. The motor 11 includes a valve seating mechanism, generally designated 75. As is well known by those skilled in the art, it is necessary to maintain the valve surfaces 71 and 73 in sealing engagement with each other, in order to prevent leakage between the fluid chambers 59 and 63, which would result in stalling of the motor. The valve seating mechanism 75 includes an annular balancing ring member 77 which is seated against a rearward surface 79 of the valve member 55. The ring member 77 includes a rearwardly projecting, integral ring portion which is received within an annular mating chamber 81 which is neighboring the valve 55, defined by the valve housing 21. Preferably, the valve seating mechanism 75 includes certain additional structure which biases the ring member 77 against the rearward surface 79 with a certain biasing preload, and certain other structure which prevents rotation of the ring member 77 as the valve 55 rotates. Such structure is well known in the art, is shown and described in great detail in U.S. Pat. No. 3,572,983 referred to above. Because such structure is not especially relevant to the present invention, it will not be described any further.

The general operation of the low speed, high torque gerotor motor shown in FIG. 1 is also well known to those skilled in the art and is described in detail in the above-incorporated patents. For purposes of this description, it is sufficient to note that, for example, high pressure fluid may be communicated to the inlet port 57, and from there will flow through the chamber 59, the valve passages 65, the fluid passages 69, and enter the expanding volume chambers 29 causing the rotor 27 to orbit and rotate. The orbital and rotational movement of the rotor 27 will be transmitted by means of the main shaft 41 to the output shaft 31, causing rotation thereof. As the rotor 27 orbits and rotates, low pressure fluid is exhausted from the contracting volume chambers 29 and is communicated through the respective fluid passages 69 and valve passages 67 to the fluid chamber 63, and then out the fluid port 61.

It will be understood by those skilled in the art that during the mode of operation described, a certain amount of leakage fluid will flow from the pressurized, expanding volume chambers 29, between the end faces of the rotor 27 and the adjacent surfaces of the wear plate 15 and port plate 19. Such leakage fluid will enter a central, case drain region 83, i.e., the generally cylindrical chamber within which the shafts 41 and 49 are disposed. A certain amount of such leakage fluid is desirable because it flows through the rearward splines 43,45, then flows through the forward splines 37,39, and through a pair of angled passages 85 defined by the output shaft 31. The leakage fluid then flows to the left in FIG. 1, through the bearing sets 33 and 35, and into an annular chamber 87 defined by the wear plate 15. It should be noted that the motor 11 includes four O-rings 89 which are seated within the bearing housing 13, the wear plate 15, the port plate 19, and the valve housing 21. As is well known in the art, the purpose of the O-rings 89 is to prevent leakage of fluid between adjacent surfaces, to the outside of the motor. The relationship of the O-rings 89 to the present invention will be described subsequently.

Prior Art

Figure 2:
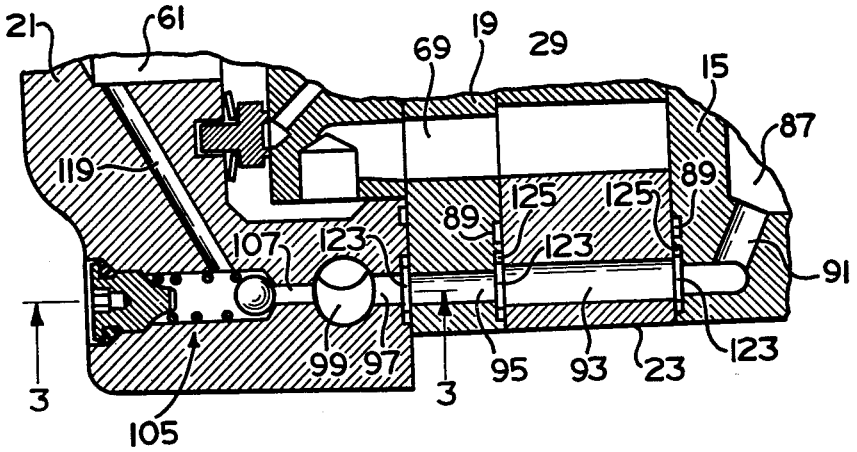
FIG. 2 PRIOR ART
FIG. 2 is a fragmentary, axial cross section, similar to FIG. 1 and on the same scale, illustrating the prior art case drain flow path.
Figure 3:
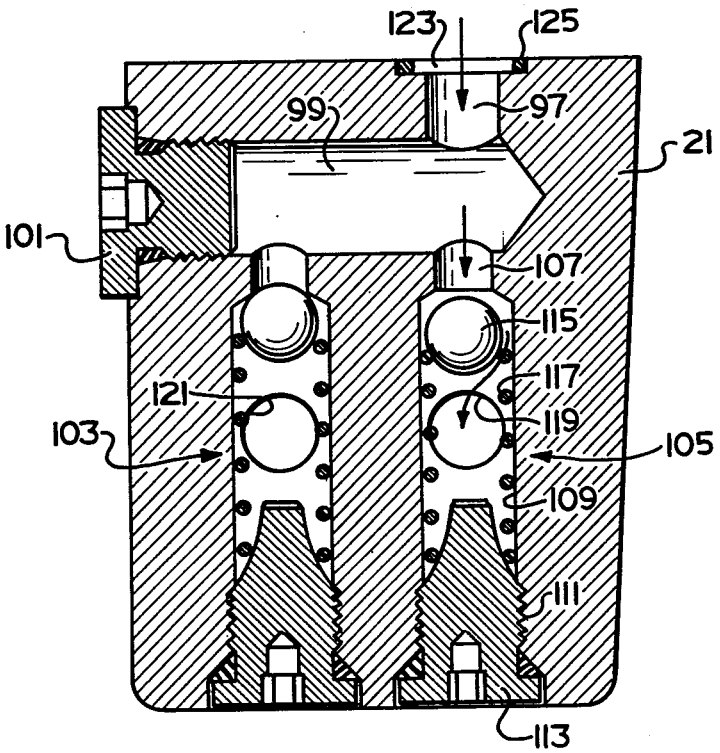
FIG. 3 PRIOR ART
FIG. 3 is a transverse cross section taken on line 3—3 of FIG. 2, still illustrating the prior art case drain flow path.

Referring now to FIGS. 2 and 3, the prior art arrangement for routing leakage fluid from the case drain region 83 will be described. In FIGS. 2 and 3, elements which are substantially the same as in FIG. 1 will bear the same numerals, and elements which are part of only the prior art will bear numerals betwen 90 and 125. Referring now primarily to FIG. 2, the wear plate 15 defines a fluid passage 91 in communication with the annular chamber 87. The gerotor ring 23 defines a fluid passage 93 communicating with passage 91, and port plate 19 defines a fluid passage 95 communicating with the passage 93.

Referring now to both FIGS. 2 and 3, the valve housing 21 defines a fluid passage 97, oriented axially, which opens into a transverse bore 99. The bore 99 is threaded to receive either a threaded plug 101 as shown in FIG. 3, or an external case drain fitting (not shown in the drawings), through which the case drain (leakage) fluid may be communicated directly to some external location, such as the system reservoir.

In communication with the transverse bore 99 is a pair of check valve assemblies 103 and 105 (see FIG. 3). The assemblies 103 and 105 may be substantially identical, and therefore, it will be understood that the detailed description herein of check valve assembly 105 applies equally to assembly 103.

The check valve assembly 105 includes a smaller diameter bore 107 and a larger diameter bore 109 which includes a set of internal threads 111, adapted to receive in threaded engagement therewith an externally threaded plug and spring seat member 113. The intersection of the bores 107 and 109 defines a valve seat, against which is seated a check ball 115. The check ball 115 is biased against the seat by a compression spring member 117, the spring 117 having its other end seated against the seat member 113.

The check valve assemblies 103 and 105 differ from each other in only one respect. In assembly 105, the larger bore 109 is in fluid communication with an angled passage 119 (see also FIG. 2), which communicates at its other end with the outlet port 61. In the assembly 103, the larger bore 109 is in fluid communication with an angled passage 121 (shown in only in FIG. 3), which communicates at its other end with the inlet port 57, by means of the chamber 59.

In the prior art arrangement for routing leakage fluid, because of the size, location, and complexity of the check valve assemblies, it was necessary that the passages 91, 93, 95, and 97 be disposed radially outwardly from the O-rings 89. As a result, it was necessary for the wear plate 15, port plate 19, and valve housing 21 each to include a trepan groove 123 and trepan seal 125 surrounding the respective passage.

Prior Art—Operation

For purposes of describing the operation of the prior art arrangement, it will be assumed that pressurized fluid is being communicated to the inlet port 57. Therefore, pressurized fluid fills the annular chamber 59 and the angled passage 121 and large bore 109 of the check valve assembly 103. The pressurized fluid in the bore 109 maintains the check ball 115 against its seat as shown in FIG. 3, thus preventing fluid communication from the transverse bore 99, through the small bore 107. At the same time, the outlet port 61 is in communication with the system reservoir, or some other source of fluid at low pressure and therefore, the angled passage 119 and large bore 109 of the check valve assembly 105 contain fluid at low pressure. Leakage fluid from the case drain region 83 flows through the passages 91 through 97 and into the transverse bore 99. Typically, the leakage fluid is about 20 to 50 psi above the pressure of the return fluid in the outlet port 61, this difference in fluid pressure being sufficient to overcome the biasing force of the spring 117 in check valve assembly 105, moving the check ball 115 away from its seat. Leakage fluid is then able to flow from the bore 99 through the small bore 107 to the angled passage 119, and through the outlet port 61 to tank. It will be understood by those skilled in the art that, if the direction of operation of the motor 11 is reversed by communicating high pressure fluid to the port 61 while connecting the port 57 to the reservoir, the operation of the check valve arrangement will be just the opposite of that described above.

Invention

Referring again to FIG. 1, one difference between the invention and the prior art is the construction and location of the fluid passages communicating with the annular chamber 87, and another difference is the intermediate destination of the leakage fluid flowing from the case drain region 83. In FIG. 1, the wear plate 15 defines a fluid passage 131, communicating with the chamber 87, the ring 23 defines a fluid passage 133, the port plate 19 defines a fluid passage 135, and the valve housing 21 defines an axial fluid passage 137 which flows into a radial passage 139. The radially outer end of the passage 139 includes a threaded portion which receives a threaded plug 141, which may be the same as the threaded plug 101 in FIG. 3, or may be replaced by an external case drain fitting as described previously.

It should be noted that the present invention facilitates moving the series of passages 131 through 137 radially inward, to a location radially inside of the O-rings 89, thus making it possible to eliminate the series of trepan grooves 123 and trepan seals 125 which were required in the prior art arrangement. As a result, one additional machining step is eliminated from each of the wear plate 15, port plate 19, and valve housing 21.

Figure 4:
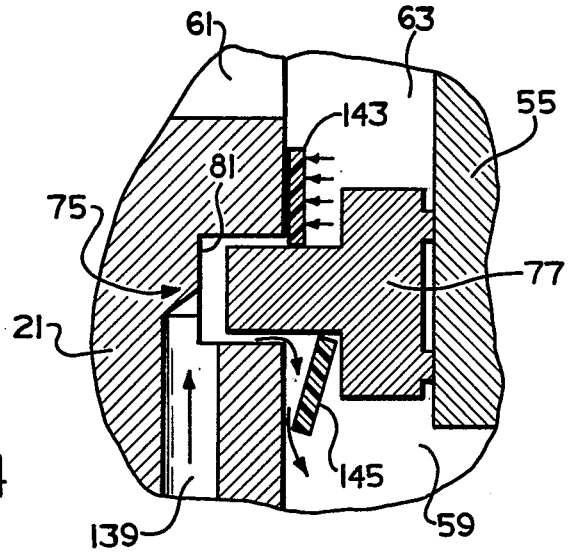
FIGS. 4 and 5 are enlarged, fragmentary cross sections similar to FIG. 1, illustrating the operation of the present invention in two different operating modes.
Figure 5:
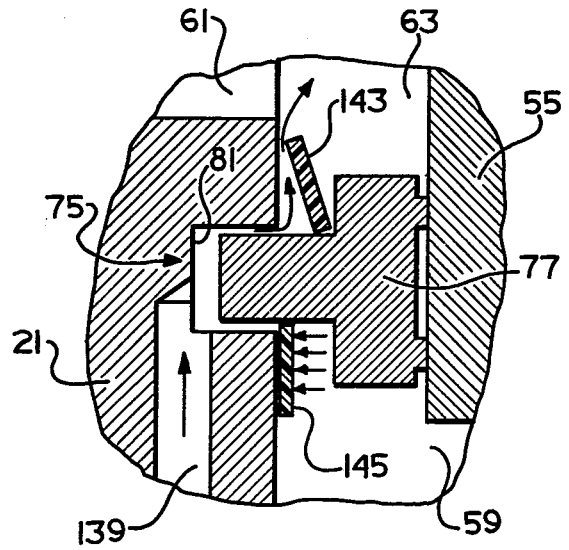

Referring now to FIGS. 4 and 5, in conjunction with FIG. 1, it may be seen that the fluid passage 139 communicates, at its radially innermost end, with the annular chamber 81 in which is seated the balancing ring member 77. As is shown in FIGS. 4 and 5, there is sufficient radial clearance between the ring member 77 and the annular chamber 81 to permit fluid to flow between the groove 81 and member 77, on either the radially inward side, or the radially outward side of the member 77.

Disposed inside the balancing ring member 77 is an inner, annular balancing ring seal 143, and disposed around the member 77 is an outer, annular balancing ring seal 145. The seals 143 and 145 are known in the prior art (such as U.S. Pat. No. 3,572,983), and have been in use commercially in motors of the general type shown in FIG. 1. It should be understood, however, that the sole function, in the prior art, of the seal 143 was to prevent communication from the fluid chamber 63 to the annular chamber 59 when the chamber 63 was pressurized, and the sole function of the seal 145 was to prevent fluid communication from the annular chamber 59 to the fluid chamber 63 when the chamber 59 was pressurized.

In accordance with another aspect of the present invention, and referring now to FIG. 4, if the port 61 and fluid chamber 63 contain pressurized fluid, thus causing the seal 143 to assume the sealing position shown in FIG. 4, leakage fluid flowing through the fluid passage 139 into the annular chamber 81 flows past the seal 145 into the annular chamber 59, and through the port 57 to the system reservoir. Thus, in the mode of operation depicted in FIG. 4, the balancing ring seal 145 serves as a check valve while it is not being subjected to high pressure fluid.

Referring now to FIG. 5, assuming that pressurized fluid is communicated to the port 57 and the annular chamber 59, the seal 145 assumes the sealing position as shown in FIG. 5. At the same time, leakage fluid still flows through the fluid passage 139 and into the annular groove 81, but now flows past the seal 143 into the fluid chamber 63, and then out the port 61. In this mode of operation then, the seal 143 acts as a check valve.

As stated previously, the seals 143 and 145 are well known in the prior art as far as their construction and their prior art function. However, it will be mentioned here that typically the seals 143 and 145 may be fabricated from any one of a number of elastomeric materials, and in the subJect embodiment, the seals are made from a polytetrafluoroethylene compound containing a glass filler. It should also be understood by those skilled in the art that various other configurations could be used for the seals 143 and 145, other than that shown in FIGS. 4 and 5. For purposes of the present invention, the essential feature is that each of the seals be able to prevent cross port leakage when it is subjected to pressurized fluid, and at the same time, be able to act as a check valve when it is subjected to return pressure.

It may be seen that the present invention provides a simpler less expensive arrangement for routing leakage fluid from the case drain region of the motor to the outlet port. For example, in the present invention, the fluid passage 137 replaces the fluid passage 97 of the prior art, while the fluid passage 139 replaces the bore 99 of the prior art, and as noted above, the balancing ring member 77 and seals 143 and 145 already constituted a part of the prior art motor. Thus, the present invention makes it possible to eliminate the pair of bores 107, the pair of bores 109 (which require internal threads 111), the angled passages 119 and 121, the pair of plug members 113, a pair of O-rings, the pair of check balls 115, and the pair of spring members 117. Also eliminated is all of the time which was previously needed for the assembly of the two check valve assemblies 103 and 105. In addition, it was important in each of the check valve assemblies that the bores 107 and 109 be coaxial, within a relatively close tolerance, in order to form an acceptable seat surface therebetween, thus adding to the manufacturing complexity and expense of the prior art arrangement.

The invention has been described in detail sufficient to enable those skilled in the art to make and use the same. Obviously, certain alterations and modifications of the invention will occur to others upon a reading and understanding of the specification, and it is intended that all such alterations and modifications are a part of the invention, insofar as they come within the scope of the appended claims.

What is claimed is:

1. A rotary fluid pressure device of the type including housing means defining fluid inlet means and fluid outlet means; fluid energy-translating displacement means associated with said housing means and defining expanding and contracting fluid volume chambers; stationary valve means defining fluid passage means in fluid communication with said expanding and contracting volume chambers; a rotary valve member defining valve passage means providing fluid communication between said inlet and outlet means and said fluid passage means, and having a valve surface associated with said stationary valve means; said housing means defining annular chamber means neighboring said rotary valve member; first and second seal means operably associated with said annular chamber means and cooperating with said housing means and said rotary valve member to define a first fluid chamber and a second fluid chamber, said first seal means substantially preventing fluid communication from said first fluid chamber to said annular chamber means, and said second seal means substantially preventing fluid communication from said second fluid chamber to said annular chamber means; said fluid inlet means being in fluid communication with one of said first and second fluid chambers, and said fluid outlet means being in fluid communication with the other of said first and second fluid chambers; said device including a fluid drain region adapted to receive leakage fluid from said displacement means; characterized by;

(a) said housing means defining fluid drain passage means providing relatively unrestricted communication between said fluid drain region and said annular chamber means; and (b) said first and second seal means being operable to permit communication of leakage fluid from said annular chamber means to said first and second fluid chambers, respectively, when said first and second fluid chambers, respectively contain fluid at a pressure below the pressure of said fluid drain region.

2. A device as claimed in claim 1 characterized by said fluid energy-translating displacement means comprising a gerotor gear set including a fixed internally-toothed member and an externally-toothed member eccentrically disposed within said internally-toothed member for orbital and rotational movement relative thereto.

3. A device as claimed in claim 1 characterized by said stationary valve means defining a transverse valve surface oriented generally perpendicular to the axis of said device.

4. A device as claimed in claim 3 characterized by said valve surface of said rotary valve member comprising a transverse valve surface in sliding, sealing engagement with said transverse valve surface of said stationary valve means, said rotary valve member comprising a disc valve member operable to rotate about an axis generally coincident with the axis of said device.

5. A device as claimed in claim 1 characterized by said annular chamber means comprising at least one annular groove disposed generally concentric to the axis of said device.

6. A device as claimed in claim 5 characterized by a valve seating mechanism including an annular balancing ring member disposed in said annular groove, said disc valve member including a surface opposite said transverse valve surface, said balancing ring member having a transverse valve-confronting surface in engagement with said opposite surface.

7. A device as claimed in claim 6 characterized by inner and outer annular balancing ring seals comprising said first and second seal means and disposed, respectively, inside and around said balancing ring member.

8. A device as claimed in claim 7 characterized by said inner and outer balancing ring seals being operable to prevent communication of pressurized fluid from said first and second fluid chambers, respectively, when said first and second fluid chambers, respectively, contain pressurized fluid.

9. A device as claimed in claim 1 characterized by said housing means comprising a plurality of sections secured together in engagement and a plurality of O-ring seals disposed to prevent fluid leakage between said sections, said fluid drain passage means comprising said sections defining a plurality of drain passages in series flow relationship, said drain passages being disposed radially inwardly of said O-ring seals.

10. A rotary fluid pressure device of the type including housing means defining a high pressure port and a low pressure port; an internal gear set associated with said housing means including an internally-toothed member and an externally-toothed member eccentrically disposed within said internally-toothed member for relative orbital and rotational motion therebetween, said toothed members defining expanding and contracting fluid volume chambers during said relative motion; stationary valve means defining fluid passage means in fluid communication with said expanding and contracting volume chambers; a rotary valve member defining valve passage means providing fluid communication between said high pressure port and said fluid passage means, and between said fluid passage means and said low pressure port, and having a valve surface in sealing, sliding engagement with said stationary valve means, and further having an opposite surface; a valve seating mechanism including said housing means defining an annular chamber and a generally annular balancing ring member disposed within said groove and having a transverse valve-confronting surface in engagement with said opposite surface of said rotary valve member; said balancing ring member cooperating with said housing means and said rotary valve member to define a first fluid chamber in fluid communication with said high pressure port and a second fluid chamber in fluid communication with said low pressure port; first and second seal means associated with said balancing ring member and being operable to substantially prevent fluid communication from said first and second fluid chambers, respectively, into said annular groove; said device including a fluid drain region adapted to receive leakage fluid from said internal gear set; characterized by:

(a) said housing means defining fluid drain passage means providing relatively unrestricted communication between said fluid drain region and said annular groove; and (b) said first seal means and said balancing ring member being operable to prevent substantially flow of fluid from said first fluid chamber to said annular groove, and said second seal means and said balancing ring member being operable to permit communication of leakage fluid from said annular groove to said second fluid chamber.

* * * * *